US008592526B2

(12) United States Patent
Fushihara et al.

(10) Patent No.: US 8,592,526 B2
(45) Date of Patent: Nov. 26, 2013

(54) GOLF BALL

(75) Inventors: Kazuhisa Fushihara, Kobe (JP); Yumi Kanemitsu, Kobe (JP); Mikio Yamada, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 201 days.

(21) Appl. No.: 12/906,331

(22) Filed: Oct. 18, 2010

(65) Prior Publication Data

US 2011/0105244 A1 May 5, 2011

(30) Foreign Application Priority Data

Oct. 30, 2009 (JP) ..... 2009-251192

(51) Int. Cl.
*A63B 37/06* (2006.01)
*A63B 37/00* (2006.01)
*C08L 9/00* (2006.01)

(52) U.S. Cl.
USPC ..... 525/261; 525/274; 524/393; 473/371; 473/377

(58) Field of Classification Search
None
See application file for complete search history.

(56) References Cited

U.S. PATENT DOCUMENTS

| | | | | |
|---|---|---|---|---|
| 5,252,652 | A * | 10/1993 | Egashira et al. | 524/392 |
| 6,489,401 | B2 * | 12/2002 | Endo | 525/193 |
| 6,583,229 | B2 | 6/2003 | Mano et al. | |
| 6,787,609 | B2 | 9/2004 | Sakagami et al. | |
| 6,838,524 | B2 * | 1/2005 | Sakagami et al. | 525/261 |
| 6,998,445 | B2 | 2/2006 | Ladd et al. | |
| 7,358,308 | B2 * | 4/2008 | Bulpett et al. | 525/245 |
| 2003/0050136 | A1 | 3/2003 | Mano et al. | |
| 2003/0064827 | A1 | 4/2003 | Sakagami et al. | |
| 2003/0119989 | A1 | 6/2003 | Ladd et al. | |
| 2006/0281586 | A1 | 12/2006 | Sullivan et al. | |
| 2008/0227567 | A1 | 9/2008 | Sullivan et al. | |

FOREIGN PATENT DOCUMENTS

| | | | |
|---|---|---|---|
| JP | 2000-5342 | A | 1/2000 |
| JP | 2001-178851 | A | 7/2001 |
| JP | 2001-198238 | A | 7/2001 |
| JP | 2001-327629 | A | 11/2001 |
| JP | 2002-338752 | A | 11/2002 |
| JP | 2003-33447 | A | 2/2003 |
| JP | 2003-38682 | A | 2/2003 |
| JP | 2004-41734 | A | 2/2004 |
| JP | 2007-7427 | A | 1/2007 |

OTHER PUBLICATIONS

Thain; Science and Golf IV; 2002; pp. 319-327.*
English Translation of Notice of Reasons for Rejection for corresponding Japanese Application No. 2009-251192 dated Sep. 6, 2011.
English Abstract of JP 61-113475-A published May 31, 1986.
Translation of Japanese Office Action dated Jun. 26, 2012 for Application No. 2009-251192.

* cited by examiner

*Primary Examiner* — David Buttner
(74) *Attorney, Agent, or Firm* — Birch, Stewart, Kolasch & Birch, LLP

(57) ABSTRACT

An object of the present invention is to provide an environmentally safe golf ball having excellent resilience. The present invention provides a golf ball having constituting members, wherein at least a part of the constituting members is formed from a rubber composition containing (a) a base rubber, (b) a co-crosslinking agent, (c) a crosslinking initiator, and (d) an organic sulfur compound, wherein the organic sulfur compound includes a disubstituted compound of thiophenol, disulfide and/or thiophenol metal salt with Br, F or $CF_3$ only at ortho positions.

11 Claims, 2 Drawing Sheets

GOLF BALL

FIELD OF THE INVENTION

The present invention relates to an environmentally safe golf ball having excellent resilience.

DESCRIPTION OF THE RELATED ART

Conventionally, as a rubber material to be used for a core of a golf ball, in order to improve the resilience of the obtained core, typically used is a material which is obtained by blending a high-cis polybutadiene as a base rubber and a co-crosslinking agent such as zinc acrylate, further adding a crosslinking initiator thereto, and conducting a radical polymerization of the base rubber and the co-crosslinking agent. It is known that adding a very small amount of an organic sulfur compound or the like to a rubber composition containing a base rubber, a co-crosslinking agent, and a crosslinking initiator as described above further improves the resilience of the core obtained from the rubber composition (e.g., Japanese Patent Publication Nos. 2001-178851 A, 2002-338752 A, and 2003-38682 A).

For example, Japanese Patent Publication No. H4-70034 B discloses a golf ball whose internal core is produced from a rubber composition in which zinc acrylate as a co-crosslinking agent, a higher fatty acid such as palmitic acid, stearic acid, and myristic acid as a co-crosslinking activator, zinc oxide as another co-crosslinking activator, and a reaction rate retarder such as 2,5-di-tert-butylhydroquinone, are blended with a rubber. Japanese Patent Publication No. 2004-41734 A discloses a golf ball whose core contains a material which is produced by a conversion reaction of a certain amount of a polybutadiene containing a first trans-isomer content, a free radical source, and a cis-trans catalyst containing a component of Group VIA in the periodic table.

Japanese Patent No. 3554526 discloses a solid golf ball in which at least one layer of a core is formed by vulcanizing and molding a rubber composition which contains a base rubber, a co-crosslinking agent, an organic peroxide, a filler, and a specific organic sulfur compound having a substituent with a substituent constant of 1.42 or more. Japanese Patent No. 3576997 discloses a solid golf ball in which at least one layer of a core is formed by vulcanizing and molding a rubber composition which contains a base rubber, a co-crosslinking agent, an organic peroxide, and tribromothiophenol, tetrabromothiophenol, or a monovalent or bivalent metal salt of the thiophenol. Japanese Patent No. 3734767 discloses a solid golf ball in which at least one layer of a core is formed by vulcanizing and molding a rubber composition which contains a base rubber, a co-crosslinking agent, an organic peroxide, and a disulfide compound which includes at least one member selected from bis(bromophenyl)disulfide, bis(dibromophenyl)disulfide, bis(tribromophenyl)disulfide, bis(tetrabromophenyl)disulfide, and bis(pentabromophenyl)disulfide. A deformation amount of the core when applying a load from 98N as an initial load to 1275 N as a final load to the core, is 3.54 mm to 6.0 mm.

SUMMARY OF THE INVENTION

However, in the golf ball disclosed in Japanese Patent Publication No. 2004-41734 A, since components of Group VIA in the periodic table (e.g., selenium and tellurium) are toxic, the golf balls using these components are not environmentally preferred. Thus, it is very difficult to put such golf balls into practical use. In Japanese Patent No. 3554526, in order to satisfy that the substituent constant is 1.42 or more, it is preferred to attach many substituents. However, in the case of attaching many substituents as described above, the number of steps of the reaction is increased, causing a complicated manufacturing process. In addition, since the number of steps of the reaction is increased, the manufacturing cost becomes high. In particular, when the substituent contains a halogen atom, it is environmentally preferred if the amount of halogen contained in the golf ball is small.

The present invention has been made in view of the above circumstances, and an object of the present invention is to provide a golf ball having excellent resilience with a relatively small halogen content.

The present invention which has solved the above-described problem provides a golf ball having constituting members, wherein at least a part of the constituting members is formed from a rubber composition containing (a) a base rubber, (b) a co-crosslinking agent, (c) a crosslinking initiator, and (d) at least one organic sulfur compound selected from the group consisting of organic sulfur compounds represented by the following formulae (1) to (4).

(1)

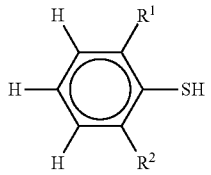

(wherein $R^1$ and $R^2$ each independently represent Br, F, or $CF_3$)

(2)

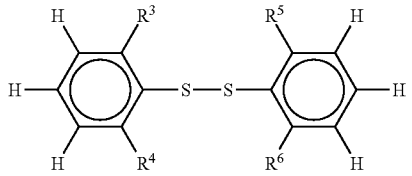

(wherein $R^3$ to $R^6$ each independently represent Br, F, or $CF_3$)

(3)

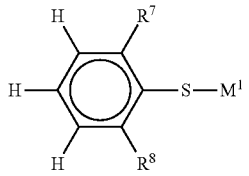

(wherein $R^7$ and $R^8$ each independently represent Br, F, or $CF_3$, and $M^1$ represents a monovalent metal atom)

(4)

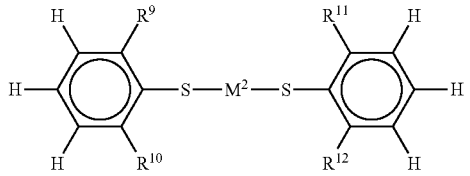

(wherein $R^9$ to $R^{12}$ each independently represent Br, F, or $CF_3$, and $M^2$ represents a bivalent metal atom)

The addition, to the rubber composition, of the organic sulfur compound as represented by the above formulae (1) to (4), that is, a thiophenol, a disulfide, and/or a thiophenol metal salt, in which two substituents are attached at ortho position in each benzene ring, can improve the resilience of a layer obtained from the rubber composition, even though the number of substituents is small. In particular, even when a halogen group is used as a substituent, the amount of halogen contained in the golf ball can be reduced by decreasing the number of substituents. Thus, a more environmentally-friendly golf ball can be obtained.

The rubber composition preferably contains 0.05 to 3 parts by mass of (d) the organic sulfur compound with respect to 100 parts by mass of (a) the base rubber.

Further, the golf ball of the present invention preferably includes a one-piece golf ball formed from the above rubber composition, or a golf ball having a core and a cover covering the core, wherein at least a part of the core is formed from the above rubber composition.

According to the present invention, it is possible to provide a golf ball having excellent resilience, even though halogen content is relatively small.

DESCRIPTION OF THE PREFERRED EMBODIMENT

Figure 1:
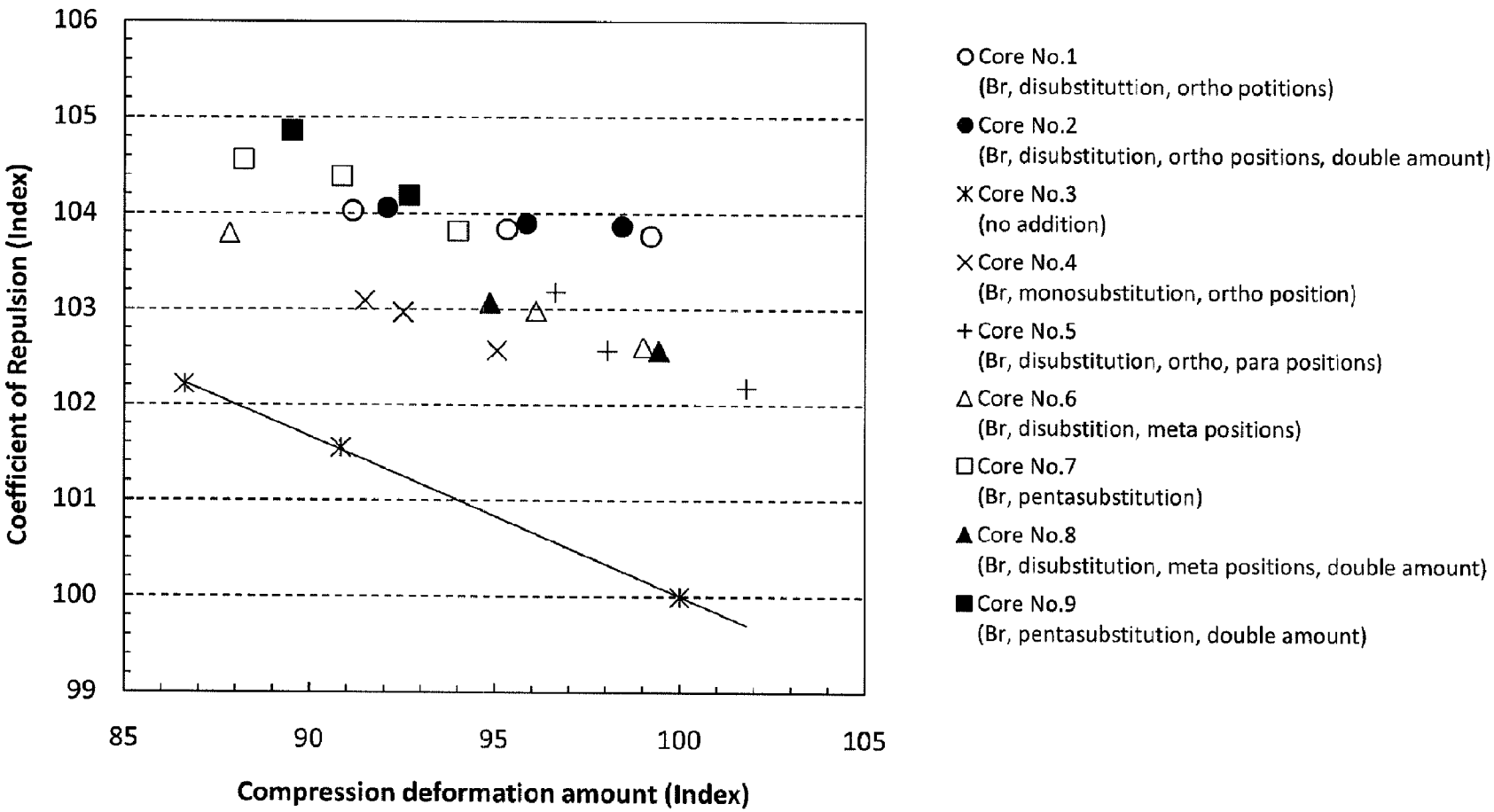
FIG. 1 is a graph which shows the relationships between the compression deformation amounts (indexes) and the coefficient of repulsion (indexes) of cores Nos. 1 to 9.

The present invention provides a golf ball having constituting members, wherein at least a part of the constituting members is formed from a rubber composition containing (a) a base rubber, (b) a co-crosslinking agent, (c) a crosslinking initiator, and (d) at least one organic sulfur compound selected from the group consisting of organic sulfur compounds represented by the following formulae (1) to (4).

(1)

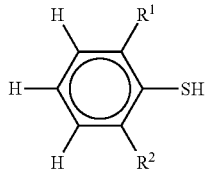

(wherein $R^1$ and $R^2$ each independently represent Br, F, or $CF_3$)

(2)

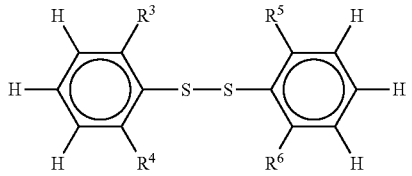

(wherein $R^3$ to $R^6$ each independently represent Br, F, or $CF_3$)

(3)

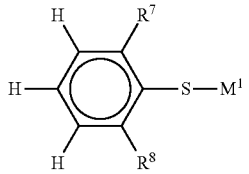

(wherein $R^7$ and $R^8$ each independently represent Br, F, or $CF_3$, and $M^1$ represents a monovalent metal atom)

(4)

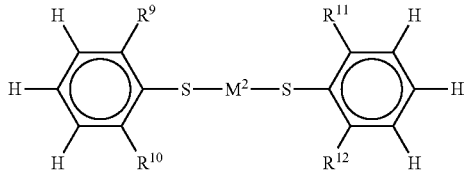

(wherein $R^9$ to $R^{12}$ each independently represent Br, F, or $CF_3$, and $M^2$ represents a bivalent metal atom)

As (a) the base rubber used in the present invention, natural rubber and/or synthetic rubber can be used. For example, polybutadiene rubber, natural rubber, polyisoprene rubber, styrene polybutadiene rubber, ethylene-propylene-diene rubber (EPDM), or the like can be used. These rubbers may be used solely or two or more of these rubbers may be used in combination. Among them, typically preferred is the high cis-polybutadiene having cis-1,4 bond in a proportion of 40% or more, more preferably 80% or more, even more preferably 90% or more in view of its superior resilience property.

The high-cis polybutadiene preferably has 1,2-vinyl bonds in a content of 2 mass % or less, more preferably 1.7 mass % or less, and even more preferably 1.5 mass % or less. If the content of 1,2-vinyl bonds is excessively high, the resilience may be lowered.

The high-cis polybutadiene is preferably one synthesized using a rare earth element catalyst. When a neodymium catalyst, which employs a neodymium compound which is a lanthanum series rare earth element compound, is used, a polybutadiene rubber having a high content of cis-1,4 bonds and a low content of 1,2-vinyl bonds is obtained with excellent polymerization activity. Such a polybutadiene rubber is particularly preferred.

The high-cis polybutadiene preferably has a Mooney viscosity ($ML_{1+4}$ (100° C.)) of 50 or more, more preferably 51 or more, even more preferably 52 or more, and most preferably 54 or more, and preferably has a Mooney viscosity ($ML_{1+4}$ (100° C.)) of 140 or less, more preferably 120 or less, even more preferably 100 or less, and most preferably 80 or less. It is noted that the Mooney viscosity ($ML_{1+4}$ (100° C.)) in the present invention is a value measured according to JIS K6300 using an L rotor under the conditions of: a preheating time of 1 minute; a rotor revolution time of 4 minutes; and a temperature of 100° C.

The high-cis polybutadiene preferably has a molecular weight distribution Mw/Mn (Mw: weight average molecular weight, Mn: number average molecular weight) of 2.0 or more, more preferably 2.2 or more, even more preferably 2.4 or more, and most preferably 2.6 or more, and preferably has a molecular weight distribution Mw/Mn of 6.0 or less, more preferably 5.0 or less, even more preferably 4.0 or less, and most preferably 3.4 or less. If the molecular weight distribution (Mw/Mn) of the high-cis polybutadiene is excessively low, the processability deteriorates. If the molecular weight distribution (Mw/Mn) of the high-cis polybutadiene is excessively high, the resilience may be lowered. It is noted that the measurement of the molecular weight distribution is conducted by gel permeation chromatography ("HLC-8120GPC", manufactured by Tosoh Corporation) using a differential refractometer as a detector under the conditions of column: GMHHXL (manufactured by Tosoh Corporation), column temperature: 40° C., and mobile phase: tetrahydrofuran, and calculated by converting, using polystyrene standard.

(b) The co-crosslinking agent is not particularly limited, as long as it has the action of crosslinking a rubber molecule by graft polymerization to a base rubber molecular chain. For example, an α,β-unsaturated carboxylic acid having 3 to 8 carbon atoms, or a metal salt thereof can be used, and preferable examples thereof include acrylic acid, methacrylic acid, and metal salts thereof. Examples of the metal for forming the metal salt include zinc, magnesium, calcium, aluminum, and sodium. As (b) the co-crosslinking agent, zinc acrylate is preferred, because the obtained golf ball has high resilience.

The blending amount of (b) the co-crosslinking agent is preferably 15 parts by mass or more, more preferably 20 parts by mass or more, and is preferably 45 parts by mass or less, and more preferably 35 parts by mass or less, with respect to 100 parts by mass of (a) the base rubber. If the blending amount of (b) the co-crosslinking agent is less than 15 parts by mass, the blending amount of (c) the crosslinking initiator, which will be described later, must be increased to have an appropriate hardness of the constituting member formed from the rubber composition. Thus, the resilience of the golf ball tends to decrease. On the other hand, if the blending amount of (b) the co-crosslinking agent exceeds 45 parts by mass, the constituting member formed from the rubber composition becomes too hard, and thus the shot feeling of the golf ball may deteriorate.

(c) The crosslinking initiator is blended in order to crosslink (a) the base rubber. As (c) the crosslinking initiator, an organic peroxide is preferred. Specific examples of the organic peroxide include organic peroxides such as dicumyl peroxide, 1,1-bis(t-butylperoxy)-3,3,5-trimethylcyclohexane, 2,5-dimethyl-2,5-di(t-butylperoxy)hexane, and di-t-butyl peroxide. These organic peroxides may be used solely or two or more of these organic peroxides may be used in combination. Among them, dicumyl peroxide is preferably used.

The blending amount of (c) the crosslinking initiator is preferably 0.2 part by mass or more, and more preferably 0.5 part by mass or more, and is preferably 5.0 parts by mass or less, and more preferably 2.5 parts by mass or less, with respect to 100 parts by mass of (a) the base rubber. If the blending amount of (c) the crosslinking initiator is less than 0.2 parts by mass, the constituting member formed from the rubber composition becomes too soft, and thus the golf ball may have the low resilience. If the blending amount of (c) the crosslinking initiator exceeds 5.0 parts by mass, the amount of (b) the co-crosslinking agent must be increased in order to obtain the appropriate hardness of the constituting member formed from the rubber composition, which tends to cause the insufficient resilience.

The following will describe (d) the organic sulfur compound used in the present invention. (d) The organic sulfur compound used in the present invention is at least one organic sulfur compound selected from the group consisting of the organic sulfur compounds represented by the above formulae (1) to (4).

Examples of the monovalent metal atom represented by $M^1$ in the above formula (3) include sodium, lithium, potassium, copper (I), and silver (I). Examples of the bivalent metal atom represented by $M^2$ in the above formula (4) include zinc, magnesium, calcium, strontium, barium, titanium (II), manganese (II), iron (II), cobalt (II), nickel (II), zirconium (II), and tin (II).

Examples of the organic sulfur compound represented by the above formula (1) include 2,6-dibromothiophenol, 2,6-difluorothiophenol, and 2,6-di(trifluoromethyl)thiophenol. Examples of the organic sulfur compound represented by the above formula (2) include bis(2,6-dibromophenyl)disulfide, bis(2,6-difluorophenyl)disulfide, and bis{2,6-di(trifluoromethyl)phenyl}disulfide. Examples of the organic sulfur compound represented by the above formula (3) include 2,6-dibromothiophenol sodium salt, 2,6-difluorothiophenol sodium salt, and 2,6-di(trifluoromethyl)thiophenol sodium salt. Examples of the organic sulfur compound represented by the above formula (4) include 2,6-dibromothiophenol zinc salt, 2,6-difluorothiophenol zinc salt, and 2,6-di(trifluoromethyl)thiophenol zinc salt.

Further, in the case of the organic sulfur compounds represented by the above formulae (1) to (4) in which the substituents are F and/or Br, in at least one of the structures represented by the following formula (5), the sum of the substituent constants of the substituents attached to this structure is preferably 0.1 or more, more preferably 0.15 or more, and even more preferably 0.18 or more, and is preferably 1.2 or less.

(5)

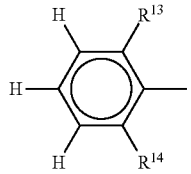

(wherein $R^{13}$ and $R^{14}$ represent $R^1$ to $R^{12}$)

Here, the term "substituent constant" in the present invention means a substituent constant in the Hammett's rule in which the influence of a substituent on the reaction rate or equilibrium of a benzene derivative is quantified. However, as is well known, the Hammett's rule applies only to meta- and para-substituted benzene derivatives, but cannot apply to ortho-substituted benzene derivatives. Thus, in the case of ortho-substituted benzene derivatives, the substituent constant means a substituent constant in the Taft equation which is obtained by expanding the Hammett's rule.

The Hammett's rule is represented by the following equation (a):

$$\log(K/K_0)=\rho\sigma \quad (a)$$

(wherein K represents the reaction value for a compound which contain a substituent; $K_0$ represents the reaction value for the compound when the substituent is not contained, i.e., when the substituent is a hydrogen atom; ρ represents the reaction constant; and σ represents the substituent constant).

The reaction constant (ρ) in the above equation (a) depends on the reaction type and the reaction conditions such as temperature and the type of solvent, and is 1.00 in the case of substituted benzoic acid, and 0.49 in the case of substituted phenyl acetic acid. The substituent constant (σ) in the above equation (a) depends only on the type and position of the substituent, and not on the reaction type. The constant is 0.00 when no substituent is present, i.e., when the substituent is a hydrogen atom.

As described above, the Hammett's rule applies only to meta- or para-substituted benzene derivatives, but cannot apply to ortho-substituted benzene derivatives which are susceptible to the influence of steric hindrance or the like. Thus, the Hammett's rule is expanded by introducing such influence of steric hindrance or the like as a positional factor, so as to allow the Hammett's rule to apply to ortho-substituted benzene derivatives, thereby obtaining the Taft equation. The Taft equation is represented by the following equation (b):

$$\log(K/K_0)=\rho^*\sigma^*+E_s \quad (b)$$

(wherein K represents the reaction value for a compound which contains a substituent; $K_0$ represents the reaction value for the compound when the substituent is not contained, i.e., when the substituent is a hydrogen atom; ρ* represents the reaction constant; σ* represents the substituent constant, and $E_s$ represents the substituent positional constant). In the above equation (b), the influence of the steric hindrance or the like on ortho-substituted benzene derivatives is introduced as a positional factor, i.e., as the substituent positional constant Es, and the component other than Es in ρσ of the above equation (a) is represented by ρ*σ*.

A method of determining the substituent constant for the structure in the above formula (5) will be specifically described. For example, in the case of 2,6-dibromothiophenol, the substituent constant of a bromo group at ortho position is 0.21, and two bromo groups are present. Thus, the substituent constant for the structure in the above formula (5) is the sum of the two substituent constants, which is 0.42. Similarly, in the case of 2,6-difluorothiophenol, the substituent constant of a fluoro group at ortho position is 0.24, and two fluoro groups are present. Thus, the substituent constant for the structure in the above formula (5) is the sum of the two substituent constants, which is 0.48. It is noted that the influence between the two substituents is neglected to determine the substituent constant for the structure in the above formula (5).

Further, values in references (e.g., "Linear Free Energy Relationships" of Peter R. Wells, p 171 to 219; "Yuki Kagaku Josetsu (Introduction to Organic Chemistry)" of Kazuhiro Maruyama et al, p 113, Apr. 1, 1989, published by Kagaku-Dojin Publishing Co., Inc.) are used as the substituent constant used in the present invention.

If an organic sulfur compound is added to a rubber composition used for a conventional golf ball, S—S bonds or C—S bonds are likely to be dissociated under vulcanizing conditions and generate radicals, and the generated radicals affect a butadiene main chain or the like. In other words, it is thought that the generated radicals affect crosslinking system between a base rubber and a co-crosslinking agent, thereby improving the resilience performance. In the present invention, among such organic sulfur compounds, the organic sulfur compounds which are represented by the above formulae (1) to (4) and have a structure in which Br, F, or $CF_3$ is attached at so-called ortho position with respect to attachment of the sulfur element, are used. By so doing, even with an organic sulfur compound having a small number of substituents, a superior effect of improving the resilience can be obtained.

The reason why, if the organic sulfur compounds represented by the above formulae (1) to (4) are added, a superior effect of improving the resilience can be obtained even with an organic sulfur compound having a small number of substituents, is not necessarily clear, but it can be considered as follows. The substituents do not influence the generation of radicals from the organic sulfur compound, but influence the control of a crosslinking reaction which takes place between the base rubber and the co-crosslinking agent. In other words, as a result of electron-withdrawing substituents being attached, the stability of a transition state formed during the reaction of the organic sulfur compound with the base rubber or the co-crosslinking agent, changes, and thus the activation energy which influences the reaction changes. Here, the stability of the transition state is almost not influenced by substituents which are attached in the organic sulfur compound at meta position and para position with respect to the sulfur element, and substituents attached at ortho position are important thereto. Thus, it is thought that, the disubstituted compound only at ortho positions provide a superior effect of improving the resilience even if the number of substituents is small.

Further, in the present invention, use of the disubstituted compound only at ortho positions having the structure in the above formula (5) (hereinafter, when merely disubstituted to pentasubstituted compounds are described, disubstituted to pentasubstituted compounds also have also the structure in the above formula (5)), can provide a superior effect of improving the resilience, and also can suppress a decrease in the compression deformation amount. In other words, the same resilience is obtained as that with a pentasubstituted compound which is conventionally thought to provide a superior effect of improving the resilience, and a golf ball having more excellent shot feeling than that with the pentasubstituted compound is obtained.

The blending amount of (d) the organic sulfur compound is preferably 0.05 part by mass or more, and more preferably 0.1 part by mass or more, and is preferably 3.0 parts by mass or less, and more preferably 2.0 parts by mass or less, with respect to 100 parts by mass of (a) the base rubber. If the blending amount of (d) the organic sulfur compound is less than 0.05 part by mass, there is the possibility that the effect by addition of (d) the organic sulfur compound will not be obtained, and the resilience of the golf ball will not improve. On the other hand, if the blending amount of (d) the organic sulfur compound exceeds 3.0 parts by mass, there is the possibility that the compression deformation amount of an obtained golf ball will become large and the resilience will be lowered.

Further, the blending ratio of (d) the organic sulfur compound to (c) the crosslinking initiator ((d) organic sulfur compound/(c) crosslinking initiator) (mass ratio) is preferably 0.01 or more, and more preferably 0.1 or more, and is preferably 1.0 or less, and more preferably 0.8 or less. If the blending ratio is less than 0.01, there is the possibility that the effect by addition of (d) the organic sulfur compound will not be obtained, and the resilience of the golf ball will not improve. On the other hand, if the blending ratio exceeds 1.0, there is the possibility that the compression deformation amount of an obtained golf ball will become large and the resilience will be lowered.

In addition to (a) the base rubber, (b) the co-crosslinking agent, (c) the crosslinking initiator, and (d) the organic sulfur compound, the rubber composition used in the present invention may contain additives, such as a pigment, a filler for adjusting specific gravity, an antioxidant, a peptizing agent, and a softener, where necessary.

Examples of the pigment blended in the rubber composition include a white pigment, a blue pigment, and a purple pigment. As the white pigment, titanium oxide is preferably used. The type of titanium oxide is not particularly limited, but rutile type is preferably used because of the high opacity. In addition, the blending amount of titanium oxide is preferably 0.5 parts by mass or more, and more preferably 2 parts by mass or more, and is preferably 8 parts by mass or less, and more preferably 5 parts by mass or less, with respect to 100 parts by mass of (a) the base rubber.

It is also preferred if the rubber composition contains both a white pigment and a blue pigment. The blue pigment is blended in order to cause white color to be vivid, and examples thereof include ultramarine blue, cobalt blue, and phthalocyanine blue. In addition, examples of the purple pigment include anthraquinone violet, dioxazine violet, and methyl violet.

The blending amount of the blue pigment is preferably 0.001 part by mass or more, and more preferably 0.05 part by mass or more, and is preferably 0.2 part by mass or less, and more preferably 0.1 part by mass or less, with respect to 100 parts by mass of (a) the base rubber. If the blending amount of the blue pigment is less than 0.001 part by mass, blueness is insufficient, and the color looks yellowish. If the blending amount of the blue pigment exceeds 0.2 part by mass, blueness is excessively strong, and a vivid white appearance is not provided.

The filler blended in the rubber composition is used as a specific gravity adjusting agent for mainly adjusting the specific gravity of a golf ball obtained as an final product so as to be in the range of 1.0 to 1.5. As the filler, any filler which is generally blended in a golf ball may be used, and examples of the filler include inorganic fillers (specifically, zinc oxide, barium sulfate, calcium carbonate, or the like), powder of a metal with a high specific gravity (e.g., tungsten powder, molybdenum powder, or the like), and mixtures thereof. Zinc oxide, which also functions as a vulcanization aid, is particularly preferred. When zinc oxide is used, the blending amount of zinc oxide is preferably 30 parts by mass or less, more preferably 25 parts by mass or less, and more preferably 15 parts by mass or less, with respect to 100 parts by mass of (a) the base rubber. If the blending amount of zinc oxide exceeds 30 parts by mass, the rubber component is reduced, and high resilience is not obtained.

The blending amount of the antioxidant is preferably 0.1 parts by mass or more and 1 part by mass or less, with respect to 100 parts by mass of (a) the base rubber. In addition, the blending amount of the peptizing agent is preferably 0.1 part by mass or more and 5 parts by mass or less, with respect to 100 parts by mass of (a) the base rubber.

The golf ball of the present invention is not particularly limited, as long as it has a layer formed from the above rubber composition. Examples of the golf ball of the present invention include a one-piece golf ball whose golf ball body is formed from the above rubber composition; a two-piece golf ball which has a core and a cover covering the core, wherein the core is formed from the above rubber composition; a three-piece golf ball which has: a core including a center and an intermediate layer covering the center; and a cover covering the core, wherein at least a part of the center and/or the intermediate layer is formed from the above rubber composition; and a multi-piece golf ball which has: a core including a center and multiple intermediate layers covering the center; and a cover covering the core, wherein at least a part of the center and/or the intermediate layer is formed from the above rubber composition.

When the golf ball of the present invention is a one-piece golf ball, the golf ball can be obtained by uniformly kneading the above rubber composition using an appropriate kneading machine such as a kneading roll, and hot-pressing the kneaded rubber composition in a mold. The hot-pressing conditions for the rubber composition may be set as appropriate in accordance with the rubber composition, but the hot-pressing is normally conducted at a temperature of 130° C. to 240° C. under a pressure of 2.9 MPa to 11.8 MPa for 15 to 60 minutes.

When the one-piece golf ball has a diameter of 42.67 mm to 42.82 mm, a compression deformation amount of the one-piece golf ball (an amount of compression of the golf ball in the compression direction thereof) when applying a load from 98 N as an initial load to 1275 N as a final load is preferably 2.3 mm or more, more preferably 2.4 mm or more, and even more preferably 2.5 mm or more, and is preferably 3.0 mm or less, more preferably 2.8 mm or less, and even more preferably 2.7 mm or less. If the compression deformation amount is 2.3 mm or more, the golf ball does not become too hard, and desired shot feeling is provided. If the compression deformation amount is 3.0 mm or less, the golf ball does not become too soft, and desired resilience is provided.

The following will describe a core in the case where the golf ball of the present invention is a two-piece golf ball, a three-piece golf ball, or a multi-piece golf ball.

Next, a preferred embodiment of the core of the golf ball of the present invention will be explained. The core of the golf ball of the present invention includes, for example, a single-layered core, a two-layered core consisting of a center and a single-layered intermediate layer covering the center; and a multi-layered core consisting of a center and multi-piece or multi-layer (particularly three or more pieces or layers) of intermediate layers covering the center. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs, preferably the surface of the spherical center is evenly divided by the ribs. In one embodiment, the ribs are preferably formed as a part of the center in an integrated manner on the surface of the center, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east(west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

When the core has a multi-layered structure, at least one layer of a center and an intermediate layer forming the core may be formed from the above rubber composition. However, the proportion of the volume of the layer formed from the above rubber composition, to the total core volume, is preferably 30% or more, more preferably 50% or more, and even more preferably 70% or more. It is noted that the core of the golf ball of the present invention is most preferably a single-layer core formed from the above rubber composition.

The core can be obtained by uniformly kneading the above rubber composition using an appropriate kneading machine such as a kneading roll, and hot-pressing the kneaded rubber composition in a mold. The hot-pressing conditions may be set as appropriate in accordance with the rubber composition, but the hot-pressing is normally conducted at a temperature of 130° C. to 240° C. under a pressure of 2.9 MPa to 11.8 MPa for 15 to 60 minutes.

The core used in the golf ball of the present invention preferably has a diameter of 32.8 mm or larger, more preferably 33.6 mm or larger, and preferably has a diameter of 40.8 mm or smaller, more preferably 40.0 mm or smaller. If the diameter of the core is smaller than 32.8 mm, the intermediate layer or the cover must be made thicker than the desired thickness, resulting in the lowered resilience. On the other hand, if the diameter of the core is larger than 40.8 mm, the cover must be made thinner than the desired thickness, the durability of the cover may deteriorate.

In the case that the core has a diameter of from 32.8 mm to 40.8 mm, the compression deformation amount (deformation amount along the shrinkage direction) of the core when applying a load from 98 N as an initial load to 1275 N as a final load is preferably 2.0 mm or more, more preferably 2.5 mm or more, and even more preferably 3.0 mm or more, and is preferably 6.0 mm or less, more preferably 5.5 mm or less, and even more preferably 5.0 mm or less. If the compression deformation amount is 2.0 mm or more, the core does not become excessively hard and the shot feeling becomes better, while if the compression deformation amount is 6.0 mm or less, the core does not become excessively soft and the resilience is getting better.

Further, when the golf ball of the present invention is a three-piece golf ball or a multi-piece golf ball, the same material as a later-described cover material can be used as the material of the intermediate layer. Examples of the material of the intermediate layer include conventionally known ionomer resins as well as thermoplastic polyamide resins, thermoplastic polyester resins, thermoplastic polyurethane resins, and thermoplastic polystyrene resins. In addition, for the intermediate layer, a specific gravity adjusting agent such as barium sulfate or tungsten, an antioxidant, a pigment, or the like may be blended.

Next, the cover of the golf ball of the present invention will be explained. Examples of the cover material constituting the cover include, various resins such as an ionomer resin, a polyester resin, polyurethane resins like a thermoplastic urethane resin and a thermosetting urethane resin, and a polyamide resin; and various thermoplastic elastomers such as a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark) (e.g. "Elastollan XNY97A")" available from BASF Japan Ltd, and thermoplastic polystyrene elastomers having a trade name "Rabalon (registered trademark) (e.g. "Rabalon T3221C")" commercially available from Mitsubishi Chemical Corporation, and the like. These cover materials may be used solely or in combination of two or more types thereof.

Examples of the ionomer resin include one prepared by neutralizing at least a part of carboxyl groups in a copolymer, composed of ethylene and α,β-unsaturated carboxylic acid having 3 to 8 carbon atoms with a metal ion; one prepared by neutralizing at least a part of carboxyl groups in a terpolymer composed of ethylene, α,β-unsaturated carboxylic acid having 3 to 8 carbons atoms, and α,β-unsaturated carboxylic acid ester with a metal ion; or a mixture of these two.

Metal ions for neutralization include: monovalent metal ions such as sodium ion, potassium ion, lithium ion, or the like; divalent metal ions such as zinc ion, calcium ion, magnesium ion, copper ion, manganese ion, or the like; trivalent metal ions such as aluminum ion, neodymium ion or the like. Among these metal ions, zinc ion is preferable, because the bonding strength of metal ion cluster is strong.

Specific examples of the ionomer resins include trade name "Himilan (registered trademark) (e.g. the binary copolymerized ionomer such as Himilan 1555 (Na), Himilan 1557 (Zn), Himilan 1605 (Na), Himilan 1706 (Zn), Himilan 1707 (Na), Himilan AM7311 (Mg), Himilan AM7329 (Zn); and the ternary copolymerized ionomer such as Himilan 1856 (Na), Himilan 1855 (Zn))" commercially available from Du Pont-Mitsui Polychemicals Co., Ltd.

Further, examples include "Surlyn (registered trademark) (e.g. the binary copolymerized ionomer such as Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li); and the ternary copolymerized ionomer such as Surlyn 6320 (Mg), Surlyn 8120 (Na), Surlyn 8320 (Na), Surlyn 9320 (Zn))" and the ternary copolymerized ionomer such as "HPF 1000 (Mg), HPF 2000 (Mg)" commercially available from E.I. du Pont de Nemours and Company.

Further, examples include "Iotek (registered trademark) (e.g. the binary copolymerized ionomer such as Iotek 8000 (Na), Iotek 8030 (Na), Iotek 7010 (Zn), Iotek 7030 (Zn); and the ternary copolymerized ionomer such as Iotek 7510 (Zn), Iotek 7520 (Zn))" commercially available from ExxonMobil Chemical Corporation. It is noted that Na, Zn, Li, and Mg described in the parentheses after the trade names indicate metal types of neutralizing metal ions for the ionomer resins.

The polyurethane resin or the polyurethane elastomer (hereinafter, merely referred to as "urethane resin") include a two-component curing type urethane resin obtained by curing an isocyanate group terminated urethane prepolymer with an aromatic polyamine or a thermoplastic urethane resin. The polyisocyanate component constituting the urethane resin is not limited, as long as it has at least two isocyanate groups. Examples of the polyisocyanate include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TOD1), xylylene diisocyanate (XDI), tetramethylxylylenediisocyanate (TMXDI), para-phenylene diisocyanate (PPDI); an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). These may be used either alone or as a mixture of at least two of them. In view of improving the weather resistance, as the polyisocyanate component of the urethane resin, a non-yellowing type polyisocyanate such as TMXDI, XDI, HDI, $H_6$XDI, IPDI, $H_{12}$MDI and NBDI is preferably used.

The polyol component constituting the urethane resin is not particularly limited as long as it has a plurality of hydroxyl groups, and such examples include a low-molecular weight polyol and a high-molecular weight polyol. Examples of the low-molecular weight polyol include a diol such as ethylene glycol, diethylene glycol, triethylene glycol, propanediol, dipropylene glycol, 1,3-butanediol, 1,4-butanediol, neopentyl glycol, 1,6-hexanediol; a triol such as glycerin, trimethylol propane, and hexanetriol. Examples of the high-molecular weight polyol include a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ε-caprolactone (PCL); a polycarbonate polyol such as polyhexamethylene carbonate; and an acrylic polyol. The above polyols may be used alone or as a mixture of at least two of them.

The aromatic polyamine has no limitation as long as it has at least two amino groups directly or indirectly bonded to an aromatic ring. Examples of the aromatic polyamine are a type such as phenylenediamine, tolylenediamine, and diethyltoluenediamine, wherein amino groups are directly bonded to an aromatic ring; a type such as dimethylthiotoluenediamine wherein amino groups are bonded to an aromatic ring via a sulfide bond; a type such as xylylenediamine wherein amino groups are bonded to an aromatic ring via a lower alkylene group; and 4,4'-diaminodiphenylmethane or derivatives thereof.

The cover of the golf ball of the present invention may contain a pigment component such as a white pigment (for example, titanium oxide or zinc oxide) and a blue pigment, a gravity adjusting agent such as calcium carbonate and barium sulfate, a dispersant, an antioxidant, an ultraviolet absorber, a light stabilizer, a fluorescent material or a fluorescent brightener, as long as the performance of the cover does not deteriorate.

The content of the white pigment (for example, titanium oxide) is preferably 0.5 part by mass or more, more preferably 1 part by mass or more, and is preferably 10 parts by mass or less, more preferably 8 parts by mass or less based on 100 parts by mass of the resin component. The white pigment in an amount of 0.5 part by mass or more can impart opacity to the cover, while the white pigment in an amount of more than 10 parts by mass may lower the durability of the cover.

A method for molding a cover is not particularly limited, and includes a conventional method, for example, a method which comprises molding the cover composition into a half hollow-shell, covering the core with the two half hollow-shells, and subjecting the core with the two half hollow-shells to the compression-molding at the temperature ranging from 130° C. to 170° C. for 1 to 5 minutes, and a method which comprises injection molding the cover composition directly onto the core.

After the cover is molded, the mold is opened and the golf ball body is taken out from the mold, and where necessary, the golf ball body is preferably subjected to surface treatments such as deburring, cleaning, and sandblast. If desired, a paint film or a mark may be formed.

In the present invention, the thickness of the cover of the golf ball is preferably 1.0 mm or more, more preferably 1.4 mm or more, and is preferably 5.0 mm or less, more preferably 4.6 mm or less, even more preferably 2.5 mm or less. If the thickness of the cover is less than 1.0 mm, since the cover is too thin, the durability of the cover may deteriorate. If the thickness of the cover is more than 5.0 mm, the shot feeling of the golf ball may deteriorate.

EXAMPLES

Hereinafter, the present invention will be described in detail by way of example. The present invention is not limited to examples described below. Various changes and modifications can be made without departing from the spirit and scope of the present invention.

[Evaluation]

(1) Compression Deformation Amount (mm)

A compression deformation amount of the core (a shrinking amount of the core in the compression direction thereof), when applying a load from 98 N as an initial load to 1275 N as a final load to the core, was measured. The compression deformation amount of core No. 3-1 was defined as an index of 100.0, and the compression deformation amount of each core was represented by converting the compression deformation amount of each golf ball into this index.

(2) Coefficient of Repulsion

A 198.4 g of metal cylindrical object was forced to collide with each golf ball at a speed of 40 m/sec, and the speeds of the cylindrical object and the golf ball before and after the collision were measured. Based on these speeds and the mass of each object, coefficient of repulsion for each golf ball was calculated. The measurement was conducted by using twelve of each core, and the average value was regarded as the coefficient of repulsion for the core. The coefficient of repulsion of core No. 3-1 was defined as an index of 100.0, and the coefficient of repulsion of each core was represented by converting the coefficient of repulsion of each golf ball into this index.

[Production of Cores]

(1) Preparation of the Center

The rubber composition having formulations shown in Tables 1 to 7 were kneaded with a kneading roll and heat-pressed in upper and lower molds, each having a hemispherical cavity, at a temperature of 170° C. for 20 minutes to obtain the spherical cores having a diameter of 40.4 mm. The compression deformation amount and the coefficient of repulsion were evaluated and the results thereof were also shown in Tables 1 to 7. The relationship between the compression deformation amount (X axis) and coefficient of repulsion (Y axis) were shown in FIG. 1 and FIG. 2.

TABLE 1

| | Core No. | 1-1 | 1-2 | 1-3 | 2-1 | 2-2 | 2-3 | 3-1 | 3-2 | 3-3 |
|---|---|---|---|---|---|---|---|---|---|---|
| Formulation | BR730 | 100 | 100 | 100 | 100 | 100 | 100 | 100 | 100 | 100 |
| | Zinc acrylate | 25.0 | 25.0 | 25.0 | 25.0 | 25.0 | 25.0 | 25.0 | 25.0 | 25.0 |
| | Zinc oxide | 20.0 | 20.0 | 20.0 | 20.0 | 20.0 | 20.0 | 20.0 | 20.0 | 20.0 |
| | Bis(2,6-dibromophenyl)disulfide | 0.27 | 0.27 | 0.27 | 0.54 | 0.54 | 0.54 | — | — | — |
| | Bis(2-bromophenyl)disulfide | — | — | — | — | — | — | — | — | — |
| | Bis(2,4-dibromophenyl)disulfide | — | — | — | — | — | — | — | — | — |
| | Bis(3,5-dibromophenyl)disulfide | — | — | — | — | — | — | — | — | — |

TABLE 1-continued

| | Core No. | 1-1 | 1-2 | 1-3 | 2-1 | 2-2 | 2-3 | 3-1 | 3-2 | 3-3 |
|---|---|---|---|---|---|---|---|---|---|---|
| | Bis(pentabromopheny)disulfide | — | — | — | — | — | — | — | — | — |
| | Dicumyl peroxide | 0.7 | 1.1 | 1.5 | 1.2 | 1.8 | 2.6 | 0.2 | 0.3 | 0.4 |
| Proper- | Compression deformation amount (mm) | 5.01 | 4.81 | 4.60 | 4.97 | 4.84 | 4.65 | 5.05 | 4.59 | 4.37 |
| ties | Compression deformation amount (Index) | 99.22 | 95.33 | 91.17 | 98.44 | 95.86 | 92.10 | 100.00 | 90.85 | 86.62 |
| | Coefficient of Repulsion | 0.7904 | 0.7908 | 0.7923 | 0.7911 | 0.7913 | 0.7925 | 0.7616 | 0.7734 | 0.7784 |
| | Coefficient of Repulsion (Index) | 103.77 | 103.84 | 104.03 | 103.87 | 103.90 | 104.06 | 100.00 | 101.55 | 102.21 |

Formulation: parts by mass

TABLE 2

| | Core No. | 4-1 | 4-2 | 4-3 | 5-1 | 5-2 | 5-3 | 6-1 | 6-2 | 6-3 |
|---|---|---|---|---|---|---|---|---|---|---|
| Formu- | BR730 | 100 | 100 | 100 | 100 | 100 | 100 | 100 | 100 | 100 |
| lation | Zinc acrylate | 25.0 | 25.0 | 25.0 | 25.0 | 25.0 | 25.0 | 25.0 | 25.0 | 25.0 |
| | Zinc oxide | 20.0 | 20.0 | 20.0 | 20.0 | 20.0 | 20.0 | 20.0 | 20.0 | 20.0 |
| | Bis(2,6-dibromophenyl)disulfide | — | — | — | — | — | — | — | — | — |
| | Bis(2-bromophenyl)disulfide | 0.19 | 0.19 | 0.19 | — | — | — | — | — | — |
| | Bis(2,4-dibromophenyl)disulfide | — | — | — | 0.27 | 0.27 | 0.27 | — | — | — |
| | Bis(3,5-dibromophenyl)disulfide | — | — | — | — | — | — | 0.27 | 0.27 | 0.27 |
| | Bis(pentabromopheny)disulfide | — | — | — | — | — | — | — | — | — |
| | Dicumyl peroxide | 0.9 | 1.1 | 1.3 | 1.0 | 1.2 | 1.6 | 0.3 | 0.4 | 0.7 |
| Proper- | Compression deformation amount (mm) | 4.80 | 4.67 | 4.62 | 5.14 | 4.95 | 4.88 | 5.00 | 4.85 | 4.44 |
| ties | Compression deformation amount (Index) | 95.07 | 95.23 | 91.50 | 101.80 | 98.04 | 96.65 | 99.02 | 96.12 | 87.84 |
| | Coefficient of Repulsion | 0.7812 | 0.7842 | 0.7851 | 0.7782 | 0.7812 | 0.7858 | 0.7815 | 0.7844 | 0.7904 |
| | Coefficient of Repulsion (Index) | 102.57 | 102.97 | 103.09 | 102.18 | 102.57 | 103.18 | 102.61 | 102.99 | 103.79 |

Formulation: parts by mass

TABLE 3

| | Core No. | 7-1 | 7-2 | 7-3 | 8-1 | 8-2 | 9-1 | 9-2 |
|---|---|---|---|---|---|---|---|---|
| Formu- | BR730 | 100 | 100 | 100 | 100 | 100 | 100 | 100 |
| lation | Zinc acrylate | 25.0 | 25.0 | 25.0 | 25.0 | 25.0 | 25.0 | 25.0 |
| | Zinc oxide | 20.0 | 20.0 | 20.0 | 20.0 | 20.0 | 20.0 | 20.0 |
| | Bis(2,6-dibromophenyl)disulfide | — | — | — | — | — | — | — |
| | Bis(2-bromophenyl)disulfide | — | — | — | — | — | — | — |
| | Bis(2,4-dibromophenyl)disulfide | — | — | — | — | — | — | — |
| | Bis(3,5-dibromophenyl)disulfide | — | — | — | 0.54 | 0.54 | — | — |
| | Bis(pentabromopheny)disulfide | 0.50 | 0.50 | 0.50 | — | — | 1.00 | 1.00 |
| | Dicumyl peroxide | 0.5 | 0.8 | 1.0 | 0.6 | 0.8 | 1.0 | 1.6 |
| Proper- | Compression deformation amount (mm) | 4.75 | 4.59 | 4.45 | 5.02 | 4.79 | 4.68 | 4.52 |
| ties | Compression deformation amount (Index) | 94.00 | 90.87 | 88.22 | 99.43 | 94.87 | 92.69 | 89.52 |
| | Coefficient of Repulsion | 0.7907 | 0.7950 | 0.7964 | 0.7812 | 0.7850 | 0.7935 | 0.7986 |
| | Coefficient of Repulsion (Index) | 103.82 | 104.39 | 104.56 | 102.57 | 103.07 | 104.19 | 104.86 |

Formulation: parts by mass

TABLE 4

| | Core No. | 10-1 | 10-2 | 10-3 | 11-1 | 11-2 | 11-3 | 12-1 | 12-2 | 12-3 |
|---|---|---|---|---|---|---|---|---|---|---|
| Formu- | BR730 | 100 | 100 | 100 | 100 | 100 | 100 | 100 | 100 | 100 |
| lation | Zinc acrylate | 25.0 | 25.0 | 25.0 | 25.0 | 25.0 | 25.0 | 25.0 | 25.0 | 25.0 |
| | Zinc oxide | 20.0 | 20.0 | 20.0 | 20.0 | 20.0 | 20.0 | 20.0 | 20.0 | 20.0 |
| | Bis(2,6-difluorophenyl)disulfide | 0.14 | 0.14 | 0.14 | — | — | — | — | — | — |
| | Bis(2,6-di(trifluoro-methyl)phenyl)disulfide | — | — | — | 0.24 | 0.24 | 0.24 | — | — | — |
| | Bis(2-fluorophenyl)disulfide | — | — | — | — | — | — | 0.13 | 0.13 | 0.13 |
| | Bis(2,4-difluorophenyl)disulfide | — | — | — | — | — | — | — | — | — |
| | Dicumyl peroxide | 0.7 | 1.1 | 1.5 | 0.7 | 1.1 | 1.5 | 0.7 | 1.1 | 1.5 |

TABLE 4-continued

| | Core No. | 10-1 | 10-2 | 10-3 | 11-1 | 11-2 | 11-3 | 12-1 | 12-2 | 12-3 |
|---|---|---|---|---|---|---|---|---|---|---|
| Properties | Compression deformation amount (mm) | 4.80 | 4.72 | 4.59 | 5.01 | 4.95 | 4.75 | 4.77 | 4.69 | 4.60 |
| | Compression deformation amount (Index) | 95.07 | 93.48 | 90.91 | 99.23 | 98.04 | 94.08 | 94.47 | 92.89 | 91.11 |
| | Coefficient of Repulsion | 0.7886 | 0.7910 | 0.7925 | 0.7833 | 0.7859 | 0.7922 | 0.7820 | 0.7839 | 0.7855 |
| | Coefficient of Repulsion (Index) | 103.55 | 103.86 | 104.06 | 102.85 | 103.19 | 104.02 | 102.68 | 102.93 | 103.14 |

Formulation: parts by mass

TABLE 5

| | | Core No. | | |
|---|---|---|---|---|
| | | 13-1 | 13-2 | 13-3 |
| Formulation | BR730 | 100 | 100 | 100 |
| | Zinc acrylate | 25.0 | 25.0 | 25.0 |
| | Zinc oxide | 20.0 | 20.0 | 20.0 |
| | Bis(2,6-difluorophenyl)disulfide | — | — | — |
| | Bis(2,6-di(trifluoromethyl)phenyl)disulfide | — | — | — |
| | Bis(2-fluorophenyl)disulfide | — | — | — |
| | Bis(2,4-difluorophenyl)disulfide | 0.14 | 0.14 | 0.14 |
| | Dicumyl peroxide | 0.9 | 1.1 | 1.3 |
| Properties | Compression deformation amount (mm) | 4.82 | 4.69 | 4.61 |
| | Compression deformation amount (Index) | 95.46 | 92.89 | 91.31 |
| | Coefficient of Repulsion | 0.7852 | 0.7867 | 0.7871 |
| | Coefficient of Repulsion (Index) | 103.10 | 103.30 | 103.35 |

Formulation: parts by mass

TABLE 6

| | Core No. | 14-1 | 14-2 | 14-3 | 15-1 | 15-2 | 15-3 | 16-1 | 16-2 | 16-3 |
|---|---|---|---|---|---|---|---|---|---|---|
| Formulation | BR730 | 100 | 100 | 100 | 100 | 100 | 100 | 100 | 100 | 100 |
| | Zinc acrylate | 25.0 | 25.0 | 25.0 | 25.0 | 25.0 | 25.0 | 25.0 | 25.0 | 25.0 |
| | Zinc oxide | 20.0 | 20.0 | 20.0 | 20.0 | 20.0 | 20.0 | 20.0 | 20.0 | 20.0 |
| | Bis(pentafluorophenyl)disulfide | 0.20 | 0.20 | 0.20 | — | — | — | — | — | — |
| | Bis(2-trifluoromethylphenyl)disulfide | — | — | — | 0.18 | 0.18 | 0.18 | — | — | — |
| | Bis(3,5-di(trifluoromethyl)phenyl)disulfide | — | — | — | — | — | — | 0.24 | 0.24 | 0.24 |
| | Bis(pentakis(trifluoromethyl)phenyl)disulfide | — | — | — | — | — | — | — | — | — |
| | Dicumyl peroxide | 0.5 | 0.8 | 1.0 | 0.7 | 1.1 | 1.5 | 0.9 | 1.1 | 1.3 |
| Properties | Compression deformation amount (mm) | 4.88 | 4.76 | 4.63 | 4.93 | 4.69 | 4.58 | 5.01 | 4.82 | 4.73 |
| | Compression deformation amount (Index) | 96.65 | 94.28 | 91.70 | 97.64 | 92.89 | 90.71 | 99.23 | 95.46 | 93.68 |
| | Coefficient of Repulsion | 0.7856 | 0.7869 | 0.7898 | 0.7826 | 0.7858 | 0.7889 | 0.7824 | 0.7851 | 0.7881 |
| | Coefficient of Repulsion (Index) | 103.15 | 103.32 | 103.70 | 102.76 | 103.18 | 103.58 | 102.73 | 103.09 | 103.48 |

Formulation: parts by mass

TABLE 7

| | | Core No. | | |
|---|---|---|---|---|
| | | 17-1 | 17-2 | 17-3 |
| Formulation | BR730 | 100 | 100 | 100 |
| | Zinc acrylate | 25.0 | 25.0 | 25.0 |
| | Zinc oxide | 20.0 | 20.0 | 20.0 |
| | Bis(pentafluorophenyl)disulfide | — | — | — |
| | Bis(2-trifluoromethylphenyl)disulfide | — | — | — |
| | Bis(3,5-di(trifluoromethyl)phenyl)disulfide | — | — | — |
| | Bis(pentakis(trifluoromethyl)phenyl)disulfide | 0.45 | 0.45 | 0.45 |
| | Dicumyl peroxide | 0.5 | 0.8 | 1.0 |

TABLE 7-continued

| | | Core No. | | |
|---|---|---|---|---|
| | | 17-1 | 17-2 | 17-3 |
| Properties | Compression deformation amount (mm) | 4.99 | 4.81 | 4.72 |
| | Compression deformation amount (Index) | 98.83 | 95.27 | 93.48 |
| | Coefficient of Repulsion | 0.7858 | 0.7885 | 0.7920 |
| | Coefficient of Repulsion (Index) | 103.18 | 103.53 | 103.99 |

Formulation: parts by mass

BR730: "BR-730 (high-cis polybutadiene)" manufactured by JSR Corporation (cis-1,4 bond content = 96 mass %, 1,2-vinyl bond content = 1.3 mass %, Mooney viscosity ($ML_{1+4}$ (100° C.)) = 55, molecular weight distribution(Mw/Mn) = 3).
Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Dicumyl peroxide: "Percumyl (registered trademark) D" manufactured by NOF Corporation.

Figure 2:
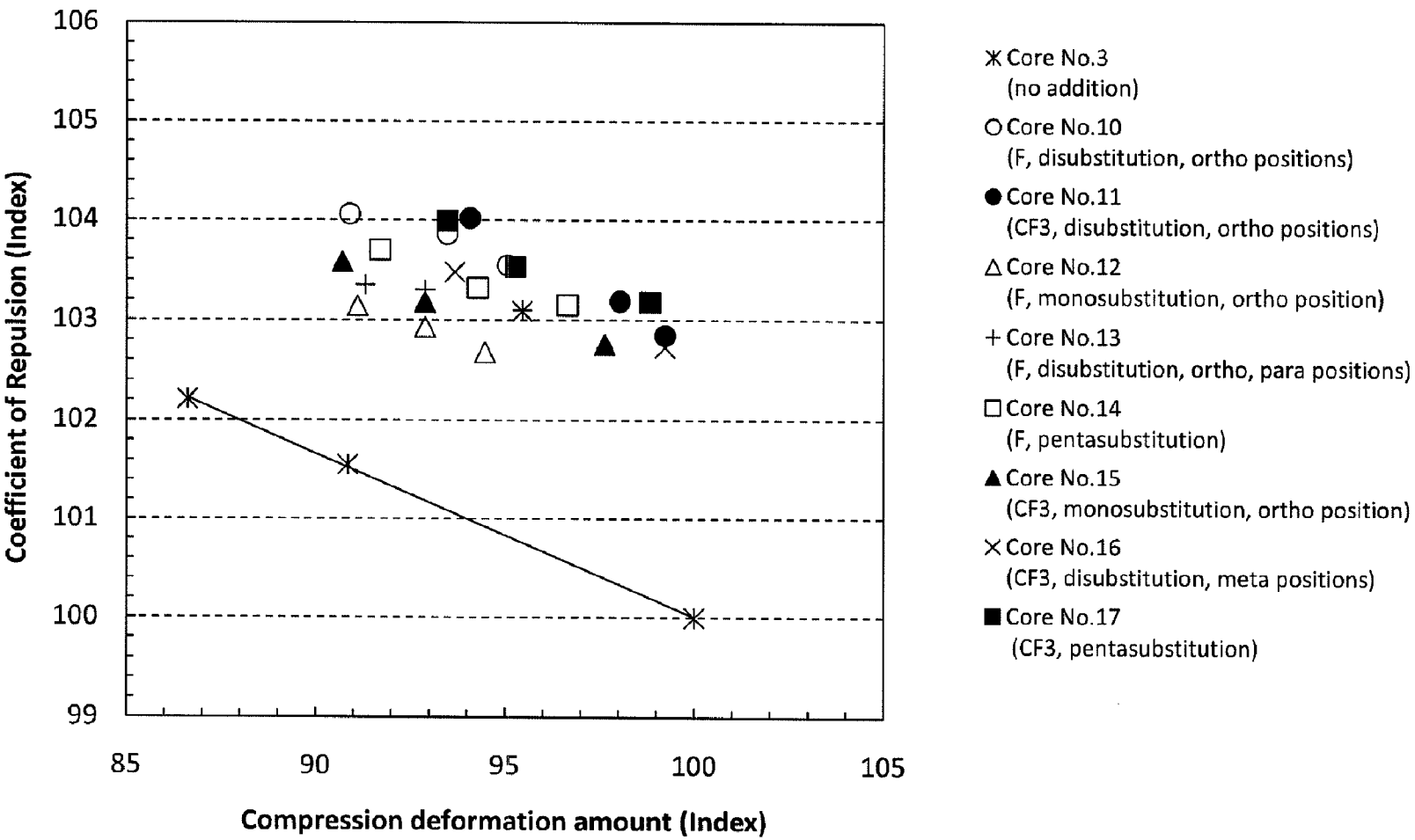
FIG. 2 is a graph which shows the relationships between the compression deformation amounts (indexes) and the coefficient of repulsion (indexes) of cores Nos. 3 and 10 to 17.

Generally, it is known that, the harder a golf ball is, the higher the resilience characteristic is. In other words, it is known that, in the same formulation series, if the adding amount of the crosslinking initiator is increased, the compression deformation amount decreases (the golf ball becomes hard), and the coefficient of repulsion improves. As shown in FIGS. 1 and 2, for cores Nos. 1 to 17, in the same formulation series, when the crosslinking initiator (DCP) is increased, the compression deformation amount is decreased, and the coefficient of repulsion is improved. Therefore, the compression deformation amount and the coefficient of repulsion satisfied a substantially linear relationship as is conventionally known.

Hereinafter, the resilience characteristic of each core will be discussed based on core No. 3, in which no organic sulfur compound was added. It is noted that the resilience characteristics of the cores are compared by referring the coefficients of repulsion at the similar level of the compression deformation amounts. When core No. 3 in which no organic sulfur compound was added is compared to cores Nos. 4 to 7 and 12 to 17 in which the different organic sulfur compounds were added, if the types of the substituents are the same, the resilience coefficient is improved as the number of the substituents is increased from the monosubstituted compound through the disubstituted compound to the pentasubstituted compound, as is conventionally known. On the other hand, in cores Nos. 1, 10, and 11 in which the ortho disubstituted compounds were added, when compared to the other disubstituted compounds (cores Nos. 5, 6, 13, and 16), the resilience characteristic is significantly improved, and the same resilience characteristic as that with a pentasubstituted compound is obtained.

In core No. 1 and core No. 2, in core No. 6 and core No. 8, or in core No. 7 and core No. 9, the same organic sulfur compound was used, but the blending amounts were different from each other. From these results, it is found that, even when the blending amount of the organic sulfur compound is increased, it does not significantly influence the resilience characteristic. In other words, it is found that the effect obtained by the ortho disubstituted compound is not provided by optimizing the blending amount.

Here, in FIGS. 1 and 2, the compression deformation amount increases toward right in the X axis direction of the graph. A higher compression deformation amount indicates that the core has excellent shot feeling because of reduced impact when hit. In addition, the coefficient or repulsion increases upward in the Y axis direction of the graph. A higher coefficient of repulsion indicates that the core has an improved flight distance. The cores located in the upper-right portion of the graph are excellent cores, in which desired shot feeling (the magnitude of the compression deformation amount) and desired flight distance (high resilience) are achieved, when compared to the cores located in the lower-left portion of the graph.

As shown in FIG. 1, cores Nos. 1 and 2 are located on the upper-right side of cores Nos. 7 and 9 in the graph. In addition, as shown in FIG. 2, core No. 10 is located on the upper-right side of core No. 14 in the graph, and core No. 11 is located on the upper-right side of core No. 17 in the graph. From these results, it is found that the same resilience as that with a pentasubstituted compound is obtained by using the ortho disubstituted compound. In other words, by using the ortho disubstituted compound, the amount of halogen to be used is reduced, and a golf ball having excellent resilience characteristic is obtained.

The present invention is useful as a environmentally safe golf ball having excellent resilience. This application is based on Japanese Patent application No. 2009-251192 filed on Oct. 30, 2009, the contents of which are hereby incorporated by reference.

The invention claimed is:

1. A golf ball having constituting members, wherein at least a part of the constituting members is formed from a rubber composition containing:

(a) a base rubber haying a molecular weight distribution Mw/Mn of from 2.0 to 3.4, (b) a co-crosslinking agent, (c) a crosslinking initiator, and (d) at least one organic sulfur compound selected from the group consisting of organic sulfur compounds represented by the following formulae (1) to (4):

(1)

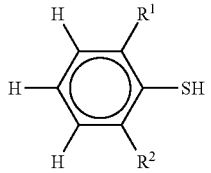

wherein $R^1$ and $R^2$ each independently represents Br or F, (2)

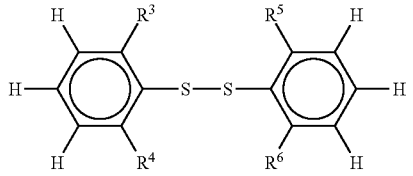

wherein $R^3$ to $R^6$ each independently represents Br or F, (3)

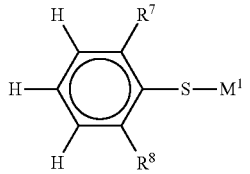

wherein $R^7$ and $R^8$ each independently represents Br or F, and $M^1$ represents a monovalent metal atom, (4)

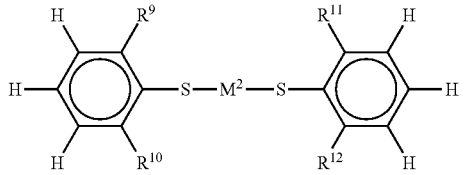

wherein $R^9$ to $R^{12}$ each independently represents Br or F, and $M^2$ represents a bivalent metal atom.

2. The golf ball according to claim 1, wherein the rubber composition contains (d) the organic sulfur compound in an amount from 0.05 part to 3 parts by mass with respect to 100 parts by mass of (a) the base rubber.

3. The golf bail according, to claim 1, wherein a blending ratio of (d) the organic sulfur compound to (c) the crosslinking initiator ((d)/(c), mass ratio) ranges from 0.01 to 1.0.

4. The golf ball according to claim 1, wherein the organic sulfur compound represented by the above formulae (1) to (4) has a substituent constant from 0.1 to 1.2 as a sum of substituent constants of the substituents in at least one of the structures represented by the following formula (5):

(5)

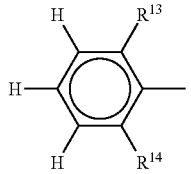

wherein $R^{13}$ and $R^{14}$ represent $R^1$ to $R^{12}$.

5. The golf ball according to claim 1, wherein (d) the organic sulfur compound contains at least one organic sulfur compound selected from the group consisting of 2,6-dibromothiophenol, 2,6-difluorothiophenol, bis(2,6-dibromophenyl)disulfide, bis(2,6-difluorophenyl)disulfide, 2,6-dibromothiophenol sodium salt, 2,6-difluorothiophenol sodium salt, and 2,6-dibromothiophenol zinc salt, and 2,6-difluorothiophenol zinc salt.

6. A golf ball comprising a core and a cover covering the core, wherein at least a part of the core is formed from a rubber composition containing:

(a) a base rubber having a molecular weight distribution Mw/Mn of from 2.0 to 3.4, (b) a co-crosslinking agent, (c) a crosslinking initiator, and (d) at least one organic sulfur compound selected from the group consisting of organic sulfur compounds represented by the following formulae (1) to (4):

(1)

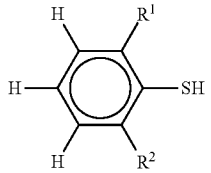

wherein $R^1$ and $R^2$ each independently represents Br or F, (2)

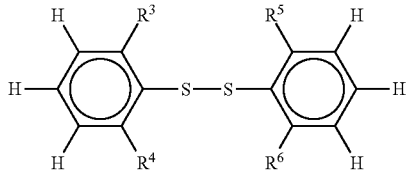

wherein $R^3$ to $R^6$ each independently represents Br or F, (3)

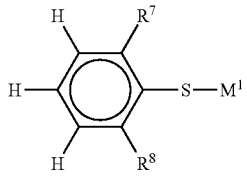

wherein $R^7$ and $R^8$ each independently represents Br or F, and $M^1$ represents a monovalent metal atom, (4)

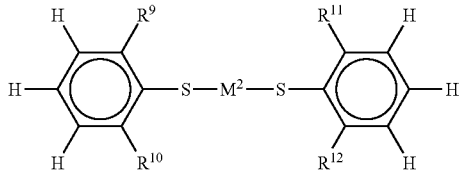

wherein $R^9$ to $R^{12}$ each independently represents Br or F, and $M^2$ represents a bivalent metal atom.

7. The golf ball according to claim 6, wherein the rubber composition contains (d) the organic sulfur compound in an amount from 0.05 part to 3 parts by mass with respect to 100 parts by mass of (a) the base rubber.

8. The golf ball according to claim 6, wherein a blending ratio of (d) the organic, sulfur compound to (c) the crosslinking initiator ((d) (c), mass ratio) ranges from 0.01 to 1.0.

9. The golf ball according to claim 6, wherein the organic sulfur compound represented by the above formulae (1) to (4)

has a substituent constant from 0.1 to 1.2 as a sum of substituent constants of the substituents in at least one of the structures represented by the following formula (5):

(5)

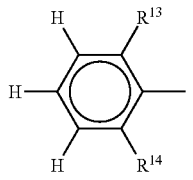

wherein $R^{13}$ and $R^{14}$ represent $R^{1}$ to $R^{12}$.

10. The golf ball according to claim 6, wherein (d) the organic sulfur compound contains at least one organic sulfur compound selected from the group consisting of 2,6-dibromothiophenol, 2,6-difluorothiophenol, bis(2,6-dibromophenyl)disulfide, bis(2,6-difluorophenyl)disulfide, 2,6-dibromothiophenol sodium salt, 2,6-difluorothiophenol sodium salt, 2,6-dibromothiophenol zinc salt, and 2,6-difluorothiophenol zinc salt.

11. The golf ball according to claim 6, wherein the core has a diameter from 32.8 mm to 40.8 mm, and has a compression deformation amount from 2.0 mm to 6.0 mm when applying a load from 98 N as an initial load to 1275 N as a final load to the core.

* * * * *